US005708425A

United States Patent [19]

Dwyer et al.

[11] Patent Number: 5,708,425

[45] Date of Patent: Jan. 13, 1998

[54] REAL TIME MESSAGING INTERFACE FOR VEHICLE DETECTION SENSORS

[75] Inventors: Douglas Dwyer, Brea; Stephen J. Feitelson, Corona, both of Calif.

[73] Assignee: Hughes Aircraft Company, Los Angeles, Calif.

[21] Appl. No.: 785,181

[22] Filed: Jan. 17, 1997

[51] Int. Cl.[6] ..... G08G 1/00

[52] U.S. Cl. ..... 340/928; 340/933; 340/937; 235/384

[58] Field of Search ..... 340/933, 937, 340/928; 235/384

[56] References Cited

U.S. PATENT DOCUMENTS

| | | | |
|---|---|---|---|
| 5,554,984 | 9/1996 | Shigenaga et al. | 340/937 |
| 5,602,375 | 2/1997 | Sunahara | 235/384 |
| 5,640,156 | 6/1997 | Okuda et al. | 340/928 |

*Primary Examiner*—Jeffery Hofsass
*Assistant Examiner*—Julie B. Lieu
*Attorney, Agent, or Firm*—G. S. Grunebach; M. W. Sales; W. K. Denson-Low

[57] ABSTRACT

A sequential messaging method for use in a vehicle detector and classification system having a processor and that uses first and second beams to detect transitions of front and rear ends of a vehicle. The method comprises detecting the vehicle when its front end breaks the first beam, assigning a new vehicle ID number to the vehicle, and transmitting a vehicle detection report containing the vehicle ID number to the processor. The vehicle is detected when its front end passes the second beam, and a vehicle detection update report is transmitted to the processor comprising left edge position, right edge position, range to each edge, vehicle height, and vehicle speed, all of which are derived from the beams reflected from the vehicle. The vehicle is detected when its rear end passes the first beam, and a rear vehicle detection report is transmitted to the processor comprising the left edge position, right edge position, range to each edge, vehicle height, and vehicle speed. The vehicle is detected when the rear end of the vehicle passes through the second beam, and a trigger report is transmitted to the processor. The data accumulated for the vehicle is compiled, and a classification report that best fits the vehicle and a confidence level of the classification estimate are generated. The classification report and confidence level are transmitted to the processor.

6 Claims, 5 Drawing Sheets

REAL TIME MESSAGING INTERFACE FOR VEHICLE DETECTION SENSORS

BACKGROUND

The present invention relates generally to vehicle detection sensors and systems, and more particularly, to a sequential messaging method for use with a vehicle detector and classification system employed in an open road toll road revenue collection system that reduces the number of messages transmitted to a processor that processes the messages to generate entry and exit transactions that are used to compute tolls for vehicles using a toll road.

The assignee of the present invention has designed and developed an open road toll collection system using transponders and cameras to track vehicles that eliminates restrictions placed upon drivers by conventional toll road collection systems. The open road toll collection system tracks vehicles located anywhere within multiple entry and exit lanes using the transponders and cameras and eliminates the need for vehicles to stop or reduce speed for fee collection.

The open road toll collection system uses a vehicle detector and classification system that provides image capture timing, vehicle position, vehicle speed, vehicle classification, and feature data that is processed to generate entry and exit transactions that are used to compute tolls for the vehicles using the toll road. The design basis of the vehicle detector and classification system was an Autosense II detector manufactured by Schwartz Electro Optics. The detector output a one megabaud continuous serial data stream to a controller that generates entry and exit transactions. However, the controller was required to reduce the data for timing, detection, location, and classification information. The vehicle detection and classification system required that the controller dedicate an immense mount of CPU time to decoding and processing the high data rate input.

It would therefore be desirable to have a method for use in the vehicle detector and classification system that improves the performance of the open road toll road revenue collection system, and in particular, reduces the volume of data transmitted for processing.

Accordingly, it is an objective of the present invention to provide for a sequential messaging method that may be used in a vehicle detector and classification system of a toll road revenue collection system that reduces the volume of data transmitted to a processor that generates entry and exit transactions that are processed to compute tolls for vehicles using the toll road.

SUMMARY OF THE INVENTION

To meet the above and other objectives, the present invention provides for a sequential messaging method that permits event driven processing to take place in a toll road revenue collection system in which it is used. The sequential messaging method is used in a vehicle detector and classification system that is part of a roadside toll collection system. The sequential messaging method reduces the volume of data transmitted from the vehicle detector and classification system to a controller that processes the data to generate entry and exit transactions that are used to compute tolls for vehicles using a toll road and provide system event timing. A series of five messages are generated for each vehicle passing by the vehicle detector and classification system. The sequential messaging method reduces the data transmitted by the vehicle detector and classification system by a factor of more than 300 compared to a system that does not use the method.

The sequential messaging method provides event timing segregated by messages. The vehicle detector and classification system transmits and detects laser light in the form of first and second fan beams through which each vehicle must pass when entering and exiting the toll road. A first message is generated when the front end of the vehicle passes the first beam. The edge positions of the vehicle at the first beam are transmitted in a second message when the front of the vehicle passes the second beam. A third message is generated when the vehicle is about to leave the coverage area of the vehicle detector and classification system and in particular when the rear end of the vehicle passes through the first beam. The third message provides edge position data on the vehicle based on the second beam. When the rear end of the vehicle passes through the second beam, a fourth message comprising a trigger report is transmitted. When the vehicle leaves the coverage area of the vehicle detector and classification system, a fifth message comprising a classification report is transmitted, which is a summary of the vehicle's type, size, and speed.

The use of the five messages in the sequential messaging method provides precise timing signals that are used for image capture or other data collection tasks. The sequential messaging method provides the data that is required by the processor to generate the entry and exit transactions using a limited set of messages. Each transmitted message contains a minimum mount of required data. The sequential messaging method uses unique vehicle identification numbers in each message for tracking multiple vehicles simultaneously. It also provides an overall data protocol that ensures data integrity.

The message sequence timing provided by the vehicle detector and classification system is key to the overall design of the roadside toll collection system. Processing in the roadside toll collection system is based upon particular events occurring as each vehicle passes the toll collection area. The messages transmitted from the vehicle detector and classification system provide timing events that start many asynchronous processes. The messages are used to start a transponder correlation process, initiate a search for adjacent detections, acquire the lane position of a vehicle, trigger imaging cameras and send a vehicle transaction report from the processor to a toll transaction processor. The sequential messaging method allows data from multiple vehicle detector and classification systems to be input to the same processor.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
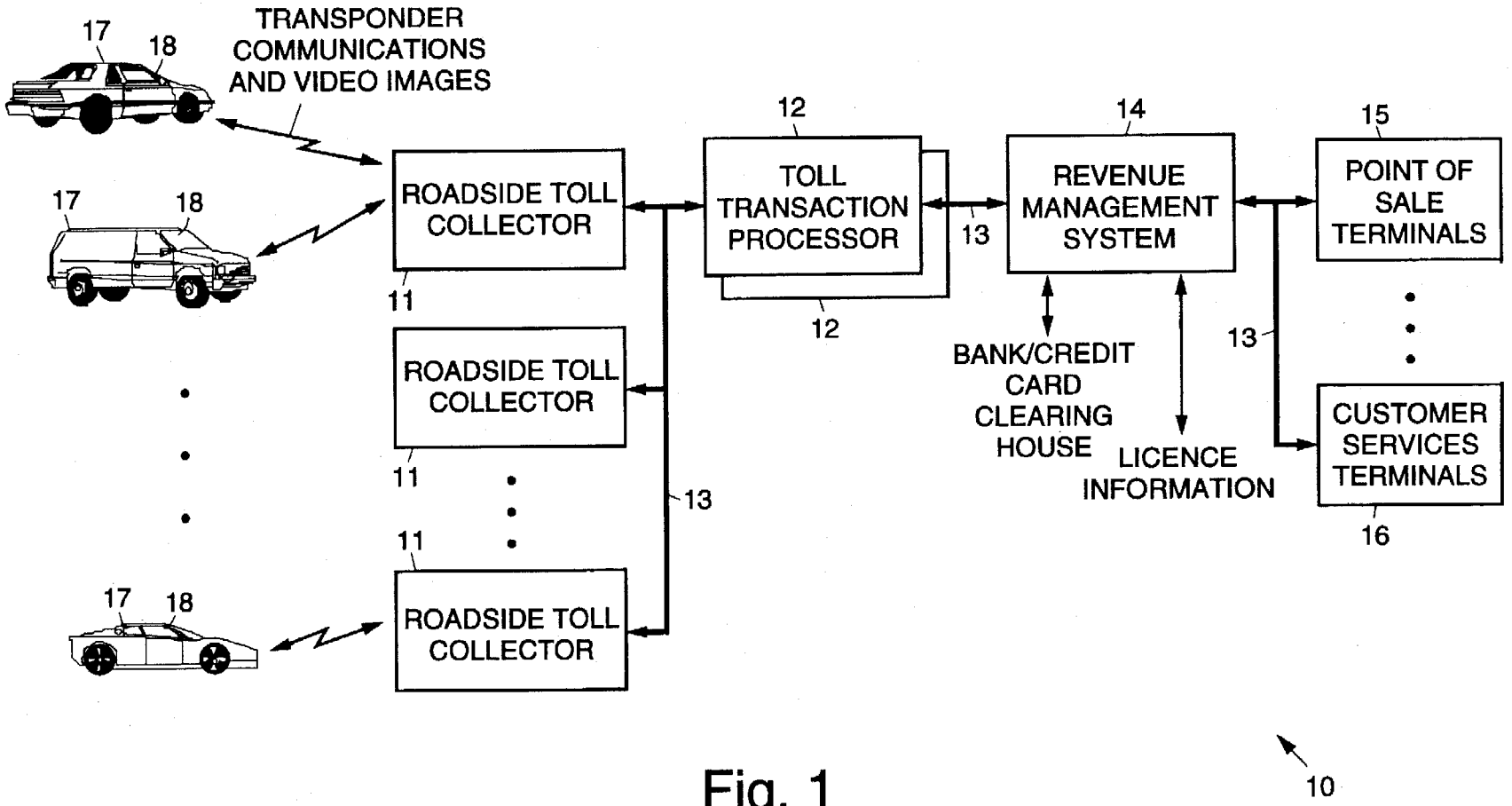
FIG. 1 illustrates a system block diagram of an open road toll collection system that employs a sequential messaging method in accordance with the principles of the present invention.

Referring to the drawing figures, FIG. 1 illustrates an open road toll collection system 10 that employs a sequential messaging method 40 in accordance with the principles of the present invention. The system 10 comprises a plurality of roadside toll collection systems 11 or roadside toll collectors 11, that are coupled by way of a fiber optic network 13 to a toll transaction processor 12. The toll transaction processor 12 is coupled by way of the fiber optic network 13 to a revenue management system 14 that interfaces with computers of an appropriate motor vehicle authority to obtain license information regarding vehicles 17, and to bank and credit card clearing houses to process bills and receive payments. The revenue management system 14 is coupled by way of the fiber optic network 13 to point of sale terminals 15 and customer service terminals 16.

Figure 2A:
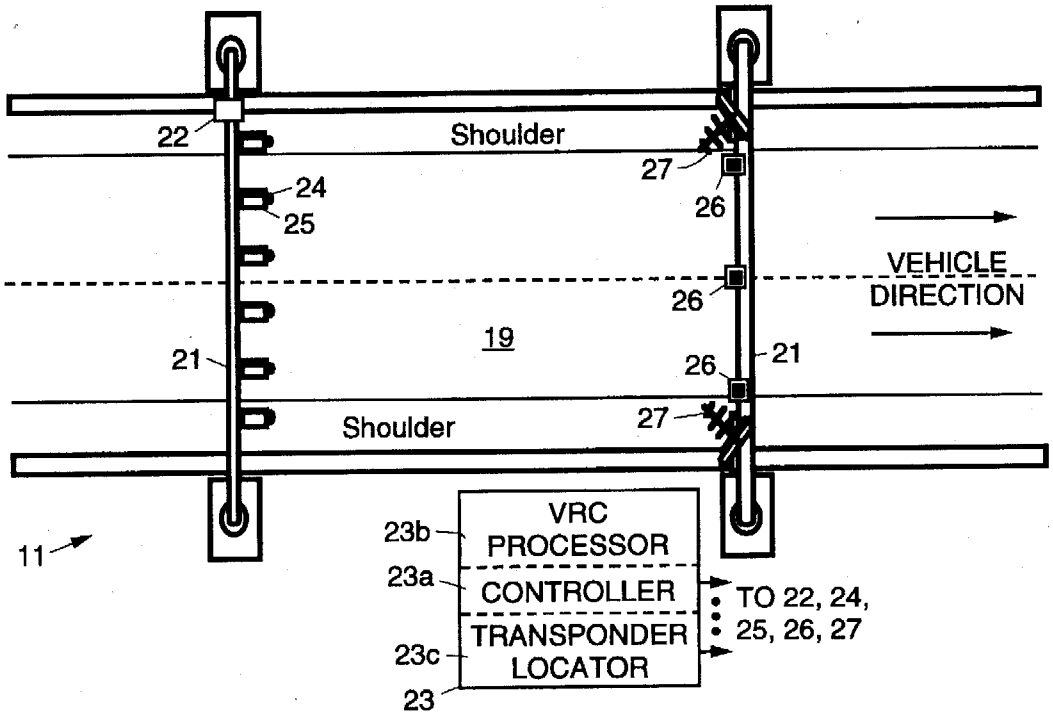
FIGS. 2*a* and 2*b* illustrate top and side views, respectively, of an embodiment of a roadside toll collector employed in the system of FIG. 1.
Figure 2B:
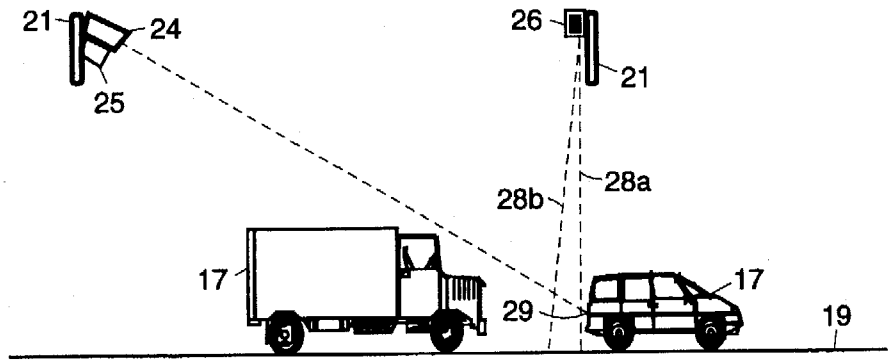

Vehicles 17 may contain transponders 18 that communicate with the roadside toll collectors 11 upon entry to and exit from a toll road 19 (FIGS. 2*a* and 2*b*). The transponder 18 transmits identification data to the roadside toll collectors 11 that is processed to determine the time of entry into and exit from the toll road 19 along with other timing events that are used during toll processing. The entry and exit data is locally processed to generate entry and exit transactions that are sent to the toll transaction processor 12. The toll transaction processor 12 computes the appropriate toll, and forwards this data to the revenue management system 14 for collection from the owner of the transponder 18.

Vehicles 17 that are not equipped with a transponder 18 may also use the toll road 19. In such cases, the system 10 has license plate cameras 24 that take video images of license plates 29 of the vehicles 17 that are processed to determine the time of entry into and exit from the toll road 19 and to bill registered owners of the vehicles 17 or generate violation notices, if required.

A more detailed description of the open road toll collection system 10 is provided in copending U.S. patent application Ser. No. 08/785,179 filed Jan. 17, 1997, entitled "An Open Road Toll Collection System and Method Using Transponders and Cameras to Identify Vehicles", assigned to the assignee of the present invention. The contents of this application are incorporated herein by reference.

Referring now to FIGS. 2*a* and 2*b*, they illustrate top and side views, respectively, of an embodiment of the roadside toll collector 11 employed in the system 10 of FIG. 1. The roadside toll collector 11 has two gantries 21 that span the entry (and exit) lanes of the toll road 19. A plurality of license plate cameras 24 are located on the first gantry 21 that is passed by the vehicles 17 that are used to image the license plates 29 of non-transponder equipped vehicles 17. A plurality of lights 25 are also disposed on the first gantry 21 that are used to illuminate the license plates 29 of the non-transponder equipped vehicles 17 in low light level conditions. A light sensor 22 may be disposed on the first gantry 21, for example, that is used to monitor the light intensity at the roadside toll collector 11 and provides feedback signals to the roadside toll collector 11 that are used to control shutter, gain, and pedestal settings of the license plate cameras 24 during changing lighting conditions that affect the quality of the imaged license plates 29.

A plurality of vehicle detector and classification systems 26 are disposed on the second gantry 21 along with a plurality of RF antennas 27 that transmit and receive RF signals that are used to communicate with the transponders 18 in transponder equipped vehicles 17. Each of the vehicle detector and classification systems 26 include a laser-based sensor that generates first and second fan-beam scanning laser beams 28*a*, 28*b* that are used to determine the speed, height, length and profile of vehicles 17 as they pass a toll collection zone. The sequential messaging method of the present invention is employed in the vehicle detector and classification systems 26 and will be discussed below with reference to FIGS. 3*a*, 3*b*, and 4.

A roadside control station 23 is disposed adjacent to the toll road 19 in the vicinity of the gantries 21. The roadside control station 23 includes a controller 23*a*, a vehicle-roadside communications (VRC) processor 23*b*, and a transponder locator 23*c*. The controller 23*a*, vehicle-roadside communications processor 23*b*, and transponder locator 23*c* are coupled to each other and transmit data and commands therebetween as required to process transactions with the roadside toll collector 11. The controller 23*a* is also coupled to the license plate cameras 24, the lights 25, the light sensor 22, and the vehicle detector and classification systems 26. The controller 23*a* is also coupled to the VRC processor 23*b* and to the antennas 27 that reads identification (ID) codes transmitted from the transponders 18.

The vehicle detector and classification system 26 employed in a reduced to practice embodiment of the system 10 is manufactured by Schwartz Electro Optics. The transponder locator 23*c* employed in the system 10 is described in U.S. Pat. No. 5,227,803 assigned to the assignee of the present invention. The VRC data decoding used for transponder communications employed in the system 10 is described in U.S. Pat. No. 5,491,713 assigned to the assignee of the present invention. The transponders 18 each have a unique ID number or ID code assigned to them, which is used for identification purposes. The transponders 18 communicate with the transponder locators using a "Slotted Aloha" Time Division Multiple Access (TDMA) communications protocol that is described in U.S. Pat. Nos. 5,307,349 and 5,425,032, assigned to the assignee of the present invention.

Figure 3A:
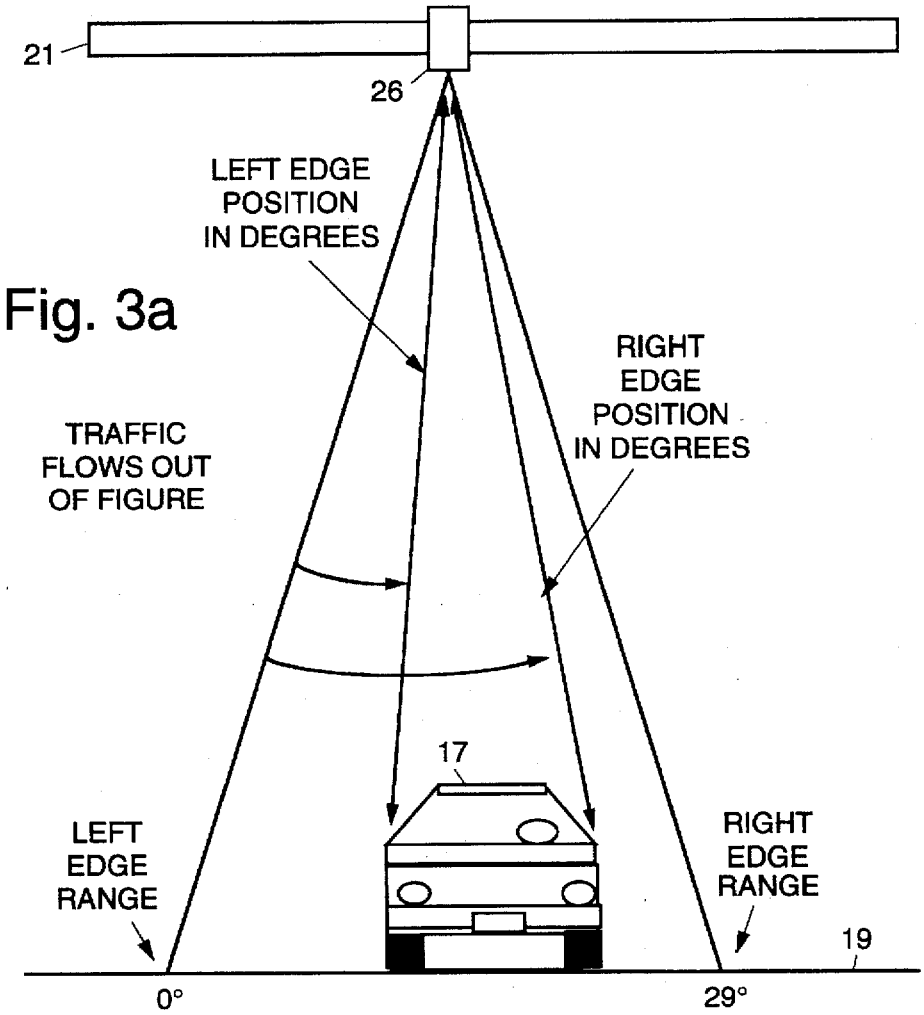
FIGS. 3*a* and 3*b* illustrate front and top views, respectively, of a vehicle detection system used in the roadside toll collector of FIGS. 2*a* and 2*b* that employs a sequential messaging method in accordance with the principles of the present invention.
Figure 3B:
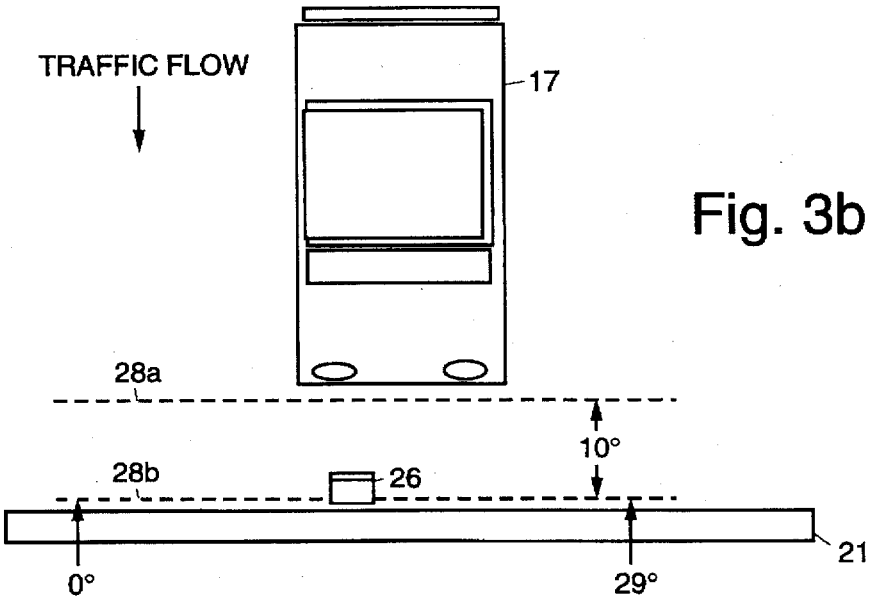

Referring now to FIGS. 3*a* and 3*b* illustrate front and top views, respectively, of the vehicle detection system 26 that employs the present sequential messaging method 40. Using the sequential messaging method 40, the vehicle detector and classification system 26 provides image capture timing, and generates vehicle position, vehicle speed, vehicle classification, and feature data. The vehicle detector and classification system 26 is located on the gantry 21 above the entry and exit ramps of the toll road 19 pointing down at the road 19. The vehicle detector and classification system 26 communicates with the processor 23*a*. In accordance with the principles of the present invention, for each vehicle 17 passing through the roadside toll collector 11, the vehicle detector and classification system 26 outputs five messages based on the location of vehicle 17 with respect to the first and second beams 28*a*, 28*b* emitted and detected by the vehicle detector and classification system 26. A vehicle ID number is used to identify the passing vehicle 17 in each of five reports output by the vehicle detector and classification system 26. As shown in FIGS. 3*a* and 3*b*, the scanning fan beams 28*a*, 28*b* scan from a 0° relative angle to a 29° relative angle across the entry and exit ramp of the toll road. The two beams 28*a*, 28*b* are separated by 10°. As the fan beams 28*a*, 28*b* scan across the road 19 they scan past the left and right edges of the vehicles 17 pass by and thus generate sensed return signals that are thereof.

Figure 4:
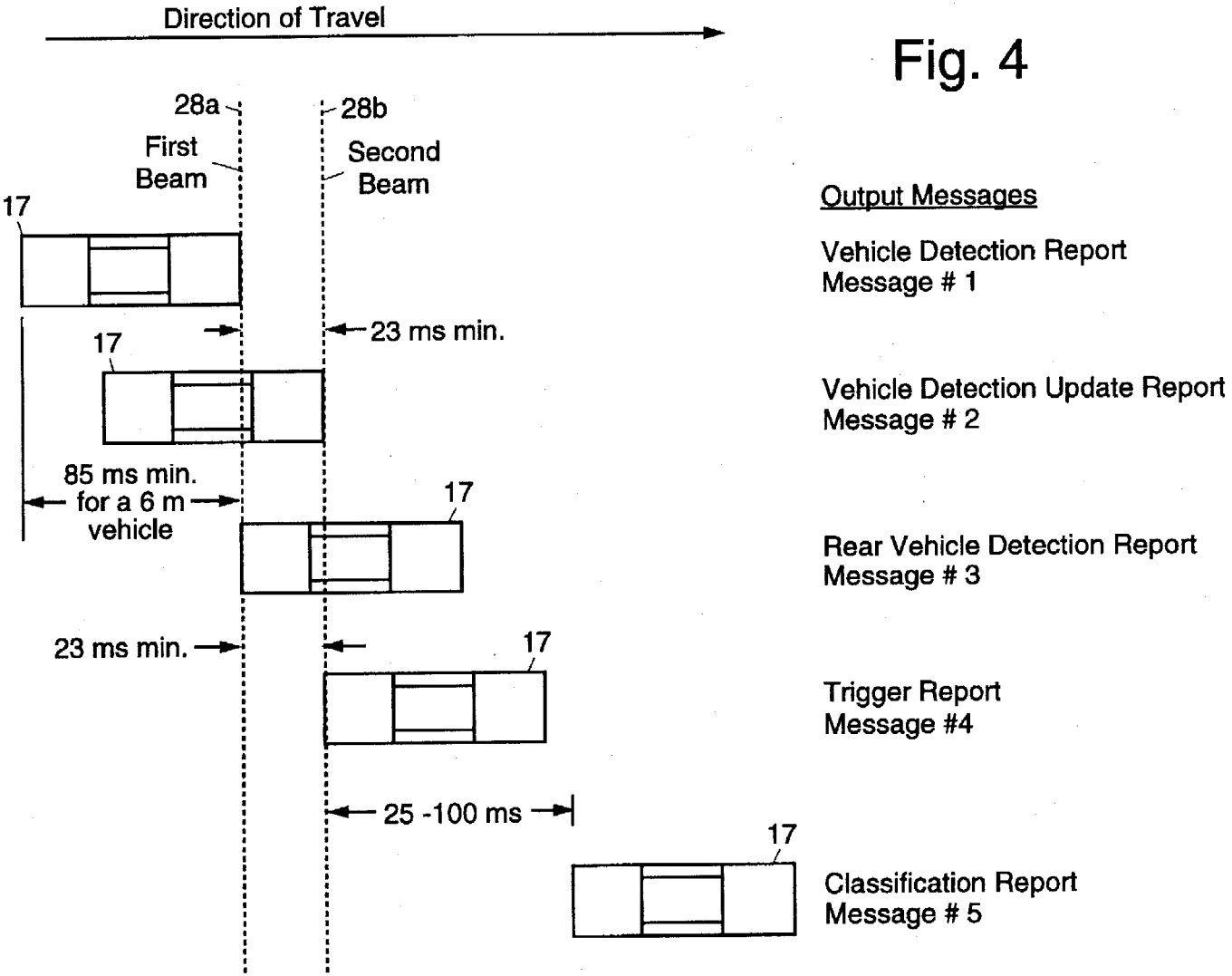
FIG. 4 illustrates messages used in implementing the sequential messaging method of the present invention.
Figure 5:
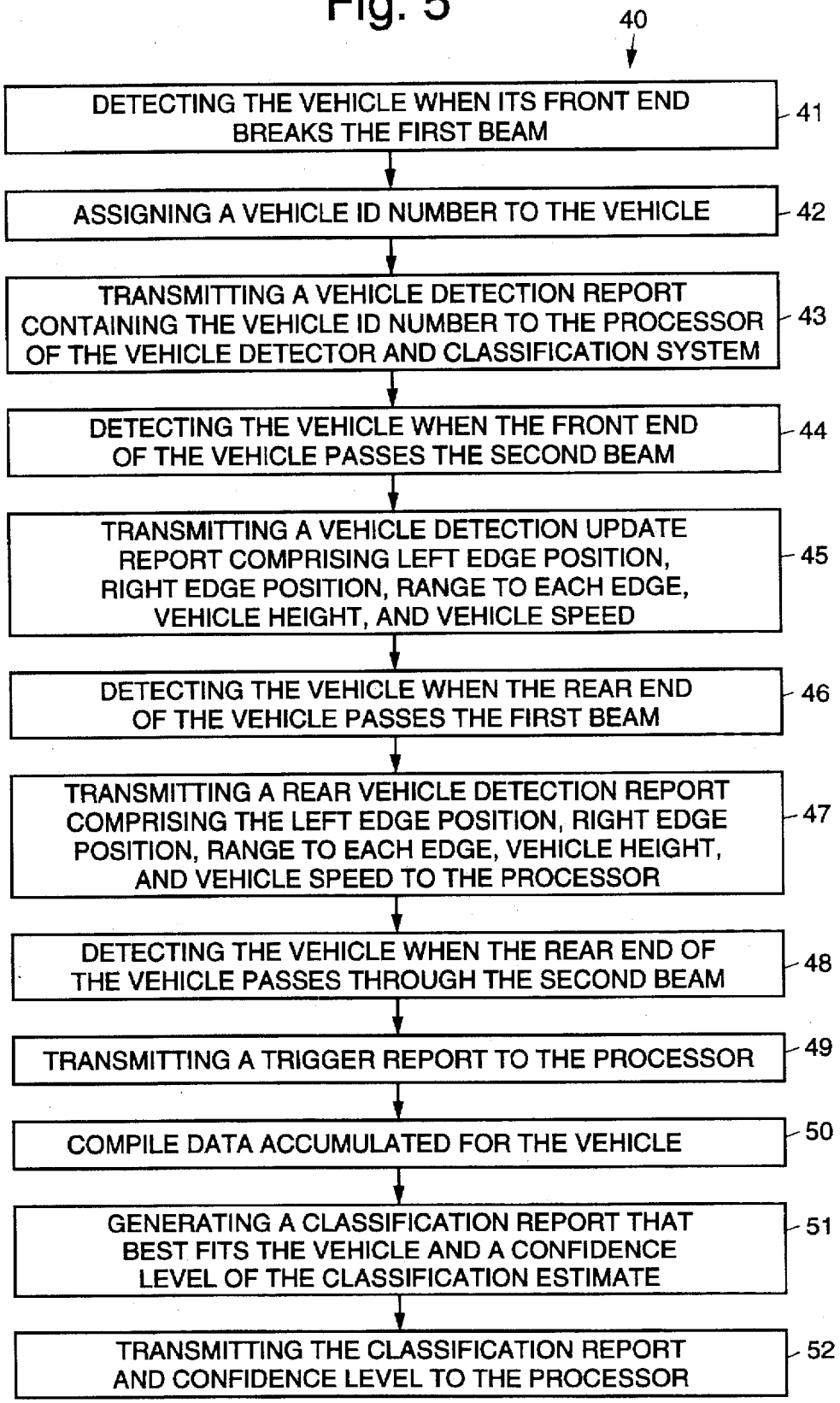
FIG. 5 is a flow chart illustrating steps of the method 40.

FIG. 4 illustrates messages used in implementing the present sequential messaging method 40, and in particular, pictorially shows the five messages. FIG. 5 is a flow chart illustrating steps of the method 40.

Referring now to FIG. 4 and 5, when a vehicle 17 passes the first gantry 21, the front bumper of the vehicle 17 breaks the first beam 28*a* generated by the vehicle detector and classification system 26. As the vehicle 17 passes through the first laser beam, the vehicle detector and classification system 26 detects 41 the vehicle 17, assigns 42 a new vehicle ID number, and transmits 43 a vehicle detection report, which is a first message provided by the sequential messaging method 40. The vehicle identification (ID) number is used for all subsequent messages pertaining to the same vehicle 17.

When the front bumper of the vehicle 17 passes the second laser beam 28*b*, the vehicle detector and classification system 26 detects 44 the vehicle 17, and transmits 45 left edge position, right edge position, range to each edge, vehicle height, and vehicle speed, all of which are computed from laser signals reflected from the vehicle 17. The vehicle detector and classification system 26 transmits 45 this data to the processor 23*a*. This data transmission is referred to as a vehicle detection update report, corresponding to message 2 of the sequential messaging method 40.

The vehicle detection update report message is used by the processor 23*a* to estimate the position of the vehicle 17. The position estimate is transferred to the controller 23*a* which correlates the position of the vehicle with the position of the transponder 18. If the transponder 18 is correlated to a vehicle 17, video images generated by license plate cameras 24 are not triggered.

When the rear bumper of the vehicle 17 clears the first laser beam 28*a*, the vehicle detector and classification system 26 detects 46 the rear of the vehicle 17, and transmits 47 the left edge position, right edge position, range to each edge, vehicle height, and vehicle speed to the processor 23*a*. This message or transmission is referred to as a rear vehicle detection report, corresponding to message 3. This message is used by the processor 23*a* to preselect license plate cameras 24 for license plate image acquisition.

The vehicle 17 continues forward and its rear bumper passes through the second laser beam 28*b*. When the rear end of the vehicle 17 is detected 48, a trigger report message is transmitted 49 by the vehicle detector and classification system 26, corresponding to message 4 to the processor 23*a*. Message 4 (the trigger report) causes the processor 23*a* to trigger the preselected license plate cameras 24 to capture images of the license plate of the vehicle 17.

The vehicle detector and classification system 26 then compiles 50 data accumulated for the vehicle 17, and generates 51 a classification report that best fits the vehicle 17 and a confidence level of the classification estimate, and transmits 52 this data to the processor 23*a*. The vehicle detector and classification system 26 may also transmit 52 subclassification data, feature data, and vehicle speed. This transmission is referred to as a classification report, corresponding to message 5.

The specifics of these five messages are outlined in the tables below.

TABLE 1

Vehicle Detection — Message 1

| Name | Description | Type | Size | Range/ value | Precision | Unit of measure |
|---|---|---|---|---|---|---|
| Message Type | Vehicle detection message — Message 1 | Byte | 1 | fixed 01 HEX | N/A | N/A |
| Vehicle ID | Unique number assigned upon detection of a new vehicle | Byte | 1 | 0–255 | 1 | N/A |

The vehicle detection message is output to the processor when a front edge of the vehicle 17 has passed the first beam 28*a*. The detected vehicle 17 is assigned a unique identification number, and the identification number is used for all subsequent messages pertaining to the same vehicle 17.

TABLE 2

Vehicle Detection Update — Message 2

| Name | Description | Type | Size | Range/ value | Precision | Unit of measure |
|---|---|---|---|---|---|---|
| Message Type | Vehicle detection update message — Message 2 | Byte | 1 | fixed 02 HEX | N/A | N/A |
| Vehicle ID | Unique number corresponding to message 1 for the same vehicle | Byte | 1 | 0–255 | 1 | N/A |
| Vehicle left edge pos. | Position of left edge of the vehicle or that the left edge is left of the VDAC | Byte | 1 | 0–29 | 1 | degree |
| Range to left edge | Slant range from the left edge of the vehicle to the road | Byte | 1 | 0–255 | 1 | quarter feet |
| Vehicle rt edge pos. | Position of right edge of the to vehicle or that the left edge is right of the VDAC | Byte | 1 | 0–29 | 1 | degree |
| Range to rt edge | Slant range from the right edge of the vehicle to the road | Byte | 1 | 0–255 | 1 | quarter feet |

TABLE 2-continued

Vehicle Detection Update — Message 2

| Name | Description | Type | Size | Range/ value | Precision | Unit of measure |
|---|---|---|---|---|---|---|
| Vehicle height | Minimum measured height for the vehicle with this ID | Byte | 1 | 0–255 | 1 | quarter feet |
| Vehicle speed | Instantaneous speed calculated by the elapsed time between message 1 and message 2 | Byte | 1 | 0–255 | 1 | miles per hour |

The vehicle detector and classification system 26 outputs a vehicle detection update report to the processor 23*a* when the front edge of the vehicle 17 has passed the second beam 28*b*. The vehicle detector and classification system 26 transmits the unique vehicle identification number used for message 1 for the same vehicle 17. In the event that the vehicle 17 is first detected by the second beam 28*b*, a new unique identification number is assigned.

This edge positions are instantaneous values based on measurements from the first beam 28*a* at the time the vehicle 17 breaks the second beam 28*b*. A reading of 0 degrees for the left edge position indicates that the left edge of the vehicle 17 is at or beyond the leftmost measurement value of the vehicle detector and classification system 26. A reading of 29 degrees on the right edge position indicates the right edge of the vehicle 17 is at or beyond the rightmost measurement value of the vehicle detector and classification system 26.

Each unit on range measurements represents one quarter of a foot. For example, a value of 10 in any range parameter would actually represent a measurement of 2.5 feet.

TABLE 3

Vehicle Detection — Message 3

| Name | Description | Type | Size | Range/ value | Precision | Unit of measure |
|---|---|---|---|---|---|---|
| Message Type | Rear vehicle detection message — Message 3 | Byte | 1 | fixed 02 HEX | N/A | N/A |
| Vehicle ID | Unique number corresponding to messages 1 and 2 for the same vehicle | Byte | 1 | 0–255 | 1 | N/A |
| Vehicle left edge pos. | Position of left edge of the vehicle or that the left edge is left of the VDAC | Byte | 1 | 0–29 | 1 | degree |
| Range to left edge | Slant range from the left edge of the vehicle to the road | Byte | 1 | 0–255 | 1 | quarter feet |
| Vehicle rt. edge pos. | Position of right edge of the to vehicle or that the left edge is right of the VDAC | Byte | 1 | 0–29 | 1 | degree |
| Range to rt. edge | Slant range from the right edge of the vehicle to the road | Byte | 1 | 0–255 | 1 | quarter feet |
| Vehicle height | Minimum measured height for the vehicle with this ID | Byte | 1 | 0–255 | 1 | quarter feet |

The vehicle detector and classification system 26 outputs a rear vehicle detection message to the processor 23*a*. The rear vehicle detection message is output any time the rear edge of the vehicle 17 has passed the first beam 28*a*. The vehicle detector and classification system 26 uses the same unique vehicle identification number that was used for message 1 for the same vehicle 17.

The edge position and range measurements are instantaneous data from the second beam 28*b* triggered by the rear edge of the vehicle 17 passing the first beam 28*a*.

TABLE 4

Vehicle Detection — Message 4

| Name | Description | Type | Size | Range/ value | Precision | Unit of measure |
|---|---|---|---|---|---|---|
| Message Type | Trigger message — Message 4 | Byte | 1 | fixed 04 HEX | N/A | N/A |
| Vehicle ID | Unique number corresponding to messages 1–3 for the same vehicle | Byte | 1 | 0–255 | 1 | N/A |

The vehicle detector and classification system 26 outputs a trigger message to the processor 23*a*. The trigger message is output at the time the rear edge of the vehicle 17 has passed the second beam 28*b*. The vehicle detector and classification system 26 uses the same unique vehicle identification number that was used for previous messages for the same vehicle 17.

TABLE 5

Classification Report — Message 5

| Name | Description | Type | Size | Range/ value | Precision | Unit of measure |
|---|---|---|---|---|---|---|
| Message Type | Classification report — Message 5 | Byte | 1 | fixed 05 HEX | N/A | N/A |
| Vehicle ID | Unique number corresponding to messages 1–4 for the same vehicle | Byte | 1 | 0–255 | 1 | N/A |
| Vehicle major classification | defines the category of vehicles which best fits the measured data<br>0 = no classification determination<br>1 = motorcycle<br>2 = motorcycle with trailer<br>3 = passenger car<br>4 = passenger car with trailer<br>5 = Pickup/Van/Sport utility<br>6 = Pickup/Van/Sport utility with trailer<br>7 = Miscellaneous truck/bus<br>8 = Miscellaneous truck/bus with trailer<br>9 = Tractor with one trailer<br>10 = Tractor with two trailers<br>11 = Tractor with three trailers<br>A stretch limousine is classified as a passenger vehicle. A tractor with no trailer is classified as a miscellaneous truck. | Byte | 1 | see description 0–11 | 1 | N/A |
| Major classification — Confidence | A number that represents the probability that the major classification estimate is accurate | Byte | 1 | 0–100 | 1 | percent |
| Vehicle subclass. | Defines a subcategory of the vehicle<br>0 = no sub classification determination<br>1 = Bus<br>2 = Pick-up<br>3 = Van | Byte | 1 | see description 0–3 | 1 | N/A |
| Subclass Confidence | A number that represents the probability that the subclassification estimate is accurate | Byte | 1 | 0–100 | 1 | percent |
| Feature data | Height | Byte | 1 | 0–255 | 1 | quarter feet |
| Feature data | Length | Byte | 1 | 0–255 | 1 | quarter feet |
| Feature data | Width | Byte | 1 | 0–255 | 1 | quarter feet |
| Feature data | Max. plateau to total length | Byte | 1 | 0–255 | 1 | quarter feet |
| Feature data | Percent above 5 feet | Byte | 1 | 0–255 | 1 | quarter feet |
| Feature data | Height above last plateau | Byte | 1 | 0–255 | 1 | quarter feet |
| Feature data | Length above last plateau | Byte | 1 | 0–255 | 1 | quarter feet |

TABLE 5-continued

| Classification Report — Message 5 | | | | | | |
|---|---|---|---|---|---|---|
| Name | Description | Type | Size | Range/ value | Precision | Unit of measure |
| Feature data | Spare | Byte | 1 | 0–255 | 1 | quarter feet |
| Vehicle speed | Most accurate estimate of vehicle speed | Byte | 1 | 0–255 | 1 | miles per hour |

The vehicle detector and classification system 26 outputs a Classification Report to the processor 23*a* for each detected vehicle 17. The vehicle detector and classification system 26 uses the same unique vehicle identification number that was used for previous messages for the same vehicle 17.

The classification report transmits major and subclassification, confidences, feature, and speed data on each vehicle 17 that is detected. The classification report message is used by the processor 23*a* to build a trip report on each vehicle 17 that passes through the roadside toll collector 11. The classification report may be used for billing purposes. The feature data is used to match vehicle reports if the license plate of a particular vehicle 17 cannot be read by the toll transaction processor 12.

Thus, a sequential messaging method for use in a vehicle detector and classification system of a toll road revenue collection system has been disclosed. It is to be understood that the described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A sequential messaging method for use in a vehicle detector and classification system having a processor and that uses first and second beams to detect transitions of front and rear ends of a vehicle, said method comprising the steps of:

detecting the vehicle when its front end breaks the first beam;

assigning a new vehicle ID number to the vehicle;

transmitting a vehicle detection report containing the vehicle ID number to the processor of the vehicle detector and classification system;

detecting the vehicle when the front end of the vehicle passes the second beam;

transmitting a vehicle detection update report comprising left edge position, right edge position, range to each edge, vehicle height, and vehicle speed, all of which are derived from the beams reflected from the vehicle to the processor;

detecting the vehicle when the rear end of the vehicle passes the first beam;

transmitting a rear vehicle detection report comprising the left edge position, right edge position, range to each edge, vehicle height, and vehicle speed to the processor;

detecting the vehicle when the rear end of the vehicle passes through the second beam;

transmitting a trigger report to the processor;

generating a classification report that best fits the vehicle and a confidence level of the classification estimate; and transmitting the classification report and confidence level to the processor.

2. The method of claim 1 wherein the vehicle detection update report is processed by the processor to estimate the position of the vehicle.

3. The method of claim 1 wherein the position estimate is transferred to the controller which correlates the position of the vehicle with the position of the transponder, and if the transponder is correlated to a vehicle, the license plate cameras are not triggered.

4. The method of claim 3 wherein the rear vehicle detection report is processed by the processor to preselect license plate cameras for license plate image acquisition.

5. The method of claim 4 wherein the trigger report causes the processor to trigger the preselected license plate cameras to capture images of the license plate of the vehicle.

6. The method of claim 5 wherein the step of transmitting the compiled data to the processor comprises the step of:

transmitting subclassification data, feature data, and vehicle speed to the processor.

* * * * *